US007611134B2

(12) United States Patent
Sussmeier et al.

(10) Patent No.: US 7,611,134 B2
(45) Date of Patent: Nov. 3, 2009

(54) CUTTER SEQUENCING METHOD AND APPARATUS

(75) Inventors: John W. Sussmeier, Cold Spring, NY (US); Boris Rozenfeld, New Milford, CT (US); William J. Wright, Killingsworth, CT (US); Daniel J. Williams, Woodbury, CT (US); John R. Masotta, Bethel, CT (US)

(73) Assignee: Pitney Bowes Inc., Stamford, CT (US)

( * ) Notice: Subject to any disclaimer, the term of this patent is extended or adjusted under 35 U.S.C. 154(b) by 325 days.

(21) Appl. No.: 11/301,769

(22) Filed: Dec. 13, 2005

(65) Prior Publication Data

US 2007/0132167 A1 Jun. 14, 2007

(51) Int. Cl.
*B65H 37/00* (2006.01)
*B65H 39/00* (2006.01)

(52) U.S. Cl. ..... 270/52.09; 270/52.01; 270/58.01; 270/52.07

(58) Field of Classification Search ..... 270/52.01, 270/52.09, 58.01; 271/182, 184, 185, 209, 271/225
See application file for complete search history.

(56) References Cited

U.S. PATENT DOCUMENTS 4,502,676 A * 3/1985 Stocker ..... 270/45
5,768,959 A 6/1998 Lorenzo
5,953,971 A * 9/1999 Jacques ..... 83/27
6,125,730 A 10/2000 Jacques
6,439,562 B1 * 8/2002 Cote et al. ..... 270/52.17
6,837,159 B2 * 1/2005 Elkotbi et al. ..... 101/219
6,955,122 B2 * 10/2005 Seiler et al. ..... 101/226
2003/0084765 A1 * 5/2003 Elkotbi et al. ..... 83/13
2003/0208992 A1 * 11/2003 Shimizu et al. ..... 53/540
2004/0028448 A1 * 2/2004 Seiler et al. ..... 400/621
2004/0080097 A1 * 4/2004 Masotta et al. ..... 271/225

FOREIGN PATENT DOCUMENTS

EP 1 577 242 A1 9/2005

* cited by examiner

*Primary Examiner*—Gene Crawford
*Assistant Examiner*—Leslie A Nicholson, III
(74) *Attorney, Agent, or Firm*—Christopher H. Kirkman; Angelo N. Chaclas

(57) ABSTRACT

An improved apparatus and method for cutting and processing sheets from a web of printed material comprising first and second side-by-side portions of sheets along a length of the web. A first transport is arranged to transport the web in a first horizontal direction. A web splitter splits portions of the web as they are transported on the first transport. An extended path transport, in line with the first transport, transports the second portion of the web in an extended path. A direct path transport, in line with the first transport, transports the first portion of the web on a more direct path. As a result of these different paths sheets within the first and second web portions are re-sequenced in a manner suitable for processing by downstream modules, such as a right angle turn module.

10 Claims, 7 Drawing Sheets

CUTTER SEQUENCING METHOD AND APPARATUS

TECHNICAL FIELD

The present invention relates to a device for sequencing sheets to be cut and processed in an inserter system.

BACKGROUND OF THE INVENTION

Inserter systems, such as those applicable for use with the present invention, are typically used by organizations such as banks, insurance companies and utility companies for producing a large volume of specific mailings where the contents of each mail item are directed to a particular addressee. Also, other organizations, such as direct mailers, use inserts for producing a large volume of generic mailings where the contents of each mail item are substantially identical for each addressee. Examples of such inserter systems are the 8 series, 9 series, and APS™ inserter systems available from Pitney Bowes Inc. of Stamford Conn.

In many respects, the typical inserter system resembles a manufacturing assembly line. Sheets and other raw materials (other sheets, enclosures, and envelopes) enter the inserter system as inputs. Then, a variety of modules or workstations in the inserter system work cooperatively to process the sheets until a finished mail piece is produced. The exact configuration of each inserter system depends upon the needs of each particular customer or installation.

Typically, inserter systems prepare mail pieces by gathering collations of documents on a conveyor. The collations are then transported on the conveyor to an insertion station where they are automatically stuffed into envelopes. After being stuffed with the collations, the envelopes are removed from the insertion station for further processing. Such further processing may include automated closing and sealing the envelope flap, weighing the envelope, applying postage to the envelope, and finally sorting and stacking the envelopes.

The input stages of a typical inserter system are depicted in FIG. 1. At the input end of the inserter system, rolls or stacks of continuous printed documents, called a "web," are fed into the inserter system by a web feeder 100. The continuous web must be separated into individual document pages. This separation is typically carried out by a web cutter 200 that cuts the continuous web into individual document pages. Downstream of the web cutter 200, a right angle turn 300 may be used to reorient the documents, and/or to meet the inserter user's floor space requirements.

The cut pages must subsequently be accumulated into collations corresponding to the multi-page documents to be included in individual mail pieces. This gathering of related document pages occurs in the accumulator module 400 where individual pages are stacked on top of one another.

The control system for the inserter senses markings on the individual pages to determine what pages are to be collated together in the accumulator module 400. In a typical inserter application, mail pieces may include varying number of pages to be accumulated. When a document accumulation is complete, then the accumulation is discharged as a unit from the accumulator 400.

Downstream of the accumulator 400, a folder 500 typically folds the accumulation of documents to fit in the desired envelopes. To allow the same inserter system to be used with different sized mailings, the folder 500 can typically be adjusted to make different sized folds on different sized paper.

Downstream of the folder 500, a buffer transport 600 transports and stores accumulated and folded documents in series in preparation for transferring the documents to the synchronous inserter chassis 700. By lining up a backlog of documents in the buffer 600, the asynchronous nature of the upstream accumulator 400 will have less impact on the synchronous inserter chassis 700. On the inserter chassis 700 inserts are added to the folded accumulation prior to insertion into an envelope at a later module.

FIG. 2 shows more details of an input portion of an inserter system. For purposes of the present invention it is not important whether a particular functionality be included in one module or another, and the description of one module having a certain functionality is exemplary. A web 120 is drawn into the inserter input subsystem. Methods for transporting the web are known and may include rollers, or tractors pulling on holes along a perforated strip at the edges of the web. The web 120 is split into two side-by-side portions by a cutting device 11. Cutting device 11 may be a stationary knife or a rotating cutting disc, or any other cutting device known in the art.

Sensors 12 and 13 scan a mark or code printed on the web 120. The mark or code identify which mail piece that particular portion of web 120 belongs to, and provides instructions for processing and assembling the mail pieces. In addition to using the scanned information for providing assembling instructions, the scanning process is useful for tracking the documents' progress through the mail piece assembly process. Once the location of a document is known based on a sensor reading, the document's position may be tracked throughout the system by monitoring the displacement of the transport system. In particular, encoders may be incorporated in the transport systems to give a reliable measurement of displacements that have occurred since a document was at a certain location.

After the web 120 has been split into at least two portions, the web is then cut into individual sheets by cutter 21. The cut is made across the web, transverse to the direction of transport. Downstream of the cutter 21 the individual cut sheets are transported to the right angle turn 30 portion of the system.

Right angle turn devices 30 are known in the art and will not be described in detail here. However, and exemplary right angle turn will comprise turn bars 32 and 33. Of the two paper paths formed by the right angle turn 30, turn bar 33 forms an inner paper path for transporting sheet 1. Turn bar 32 forms a longer outer paper path on which sheet 2 travels.

Because sheets 1 have a shorter path through the right angle turn 30, a lead edge of sheet 1 will be in front of a lead edge of sheet 2 downstream of the right angle turn 30. Also, the turn bars 32 and 33 may be arranged such that sheet 2 will lay on top of sheet 1 downstream of the right angle turn, thus forming a shingled arrangement.

In a feed cycle, the paper is advanced past the blade of the guillotine cutter 21 by a distance equal to the length of the cut sheet and is stopped. In a cut cycle, the blade 21 lowers to shear off the sheet of paper, and then withdraws from the paper. As soon as the blade 21 withdraws from the paper path, the next feed cycle begins. The feed and cut cycles are carried out in such an alternate fashion over the entire operation.

Thus, it can be seen in this right handed turn arrangement of FIG. 2 that in order to keep the sheets in the proper sequence, i.e. sheets 1 leading sheet 2, it is important for sheet 1 (and subsequent odd numbered sheets) to enter the right angle turn module 30 on the right side. The cutter 21 depicted in FIG. 2 would typically be a right to left guillotine cutter, whereby right sheets can be cut and released before the left sheets are cut.

If the lead sheet 1 were positioned on the left side, as depicted in FIG. 3, then using prior art techniques a left handed right angle turn module 30 would have to be substituted. The arrangement shown in FIG. 3, would be unacceptable using prior art techniques.

SUMMARY OF THE INVENTION

An improved apparatus and method is described herein for cutting and processing sheets from a web of printed material. The web is comprised of first and second side-by-side portions of sheets along a length of the web. The first and second portions each having a series of aligning printed sheets.

A first transport is arranged to transport the web in a first horizontal direction along the length of the web. A web splitter is arranged to split the first and second portions of the web as they are transported on the first transport.

An extended path transport is provided in line with the first transport to transport the second portion of the web in an extended path. A direct path transport in line with the first transport arranged to transport the first portion of the web on a more direct path. As a result of these different paths for the first and second web portions, downstream the first portion and the second portions are returned to a side-by-side arrangement on the first transport with the second portion one sheet length behind its original position next to the first portion.

A sheet cutting device is arranged to transversely cut the first and second portions to separate them into separate side-by-side sheets. This sheet cutting device may be positioned before or after the extended path and the direct path portions of the transport, and the structure of those paths will vary depending on whether the portions are still attached, or cut into separate sheets.

A right angle turn module is positioned downstream for receiving and turning pairs of cut side-by-side sheets traveling in the first direction. After the right angle turn module, the pairs of sheets are reoriented to be traveling serially in a second direction orthogonal to the first direction on a second transport. Also after right angle turning, within the pair of turned sheets, a sheet from the second web portion is traveling downstream of a sheet from the first web portion.

Thus, by providing a longer path for the second portion of the web, the problem described above can be solved. The output of the right angle turn module provides the sheets in the proper sequence, even if the web was printed with the first and second portions transposed from the arrangement that would normally be suitable for the direction of that right angle turn.

Further details of the present invention are provided in the accompanying drawings, detailed description and claims.

DETAILED DESCRIPTION

Figure 1:
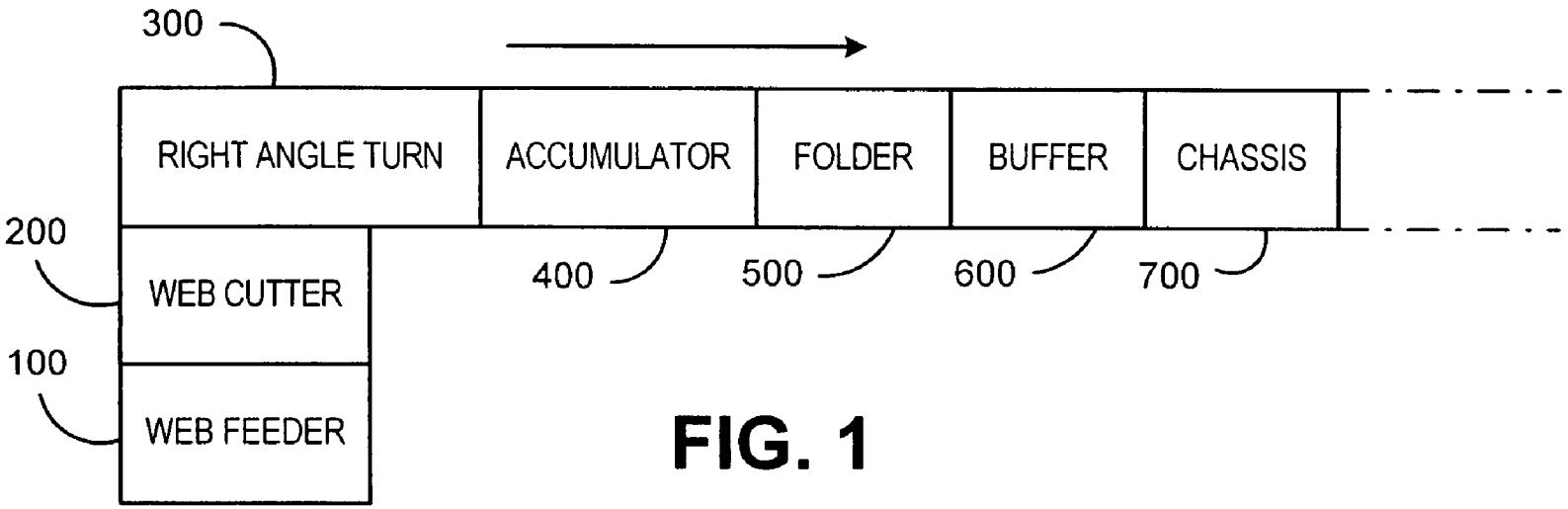
FIG. 1 is a diagram of the input stages of an inserter system for use with the present invention.
Figure 2:
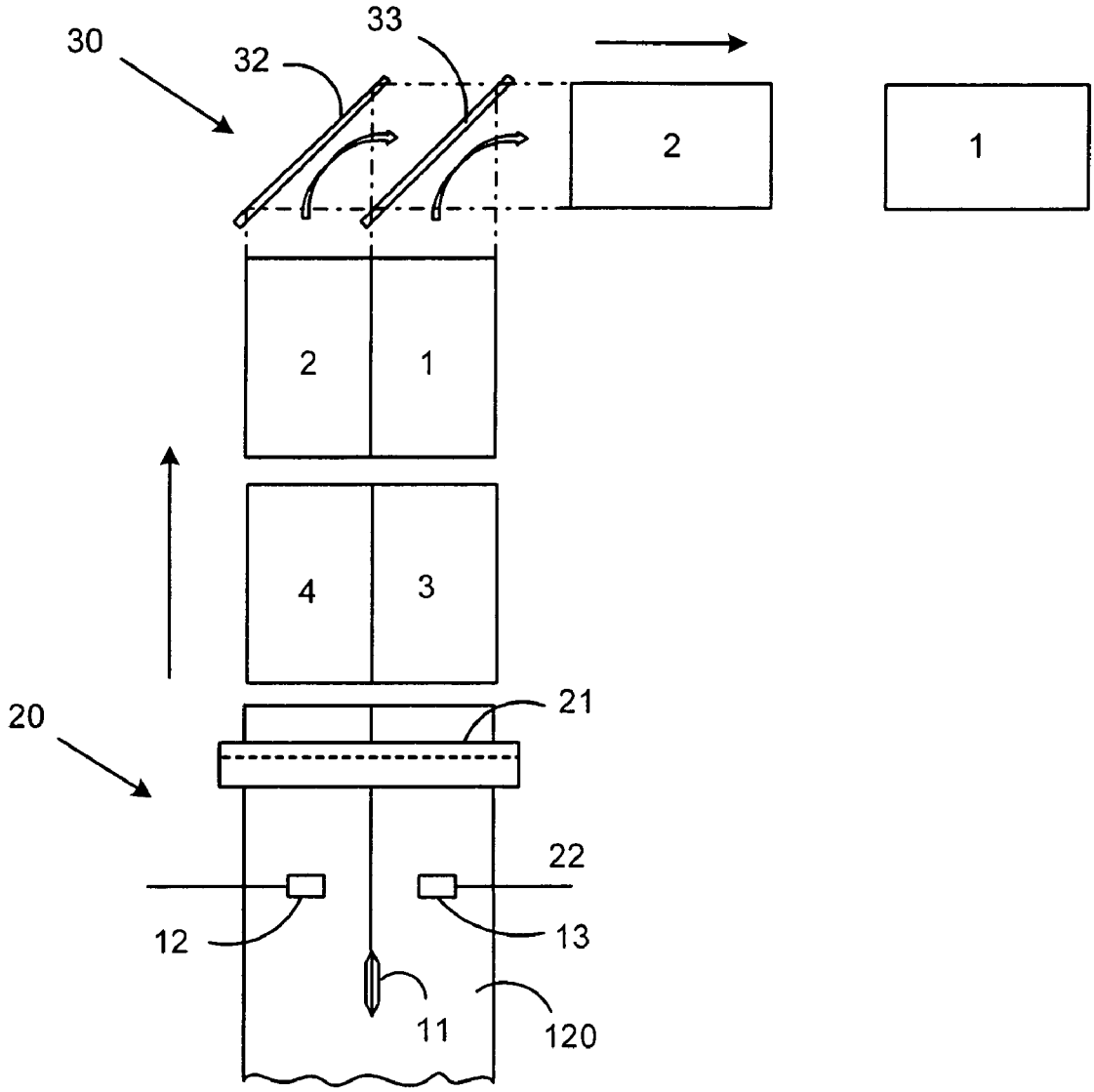
FIG. 2 ( PRIOR ART )
FIG. 2 depicts a prior art arrangement for turning and sequencing sheets.
Figure 3:
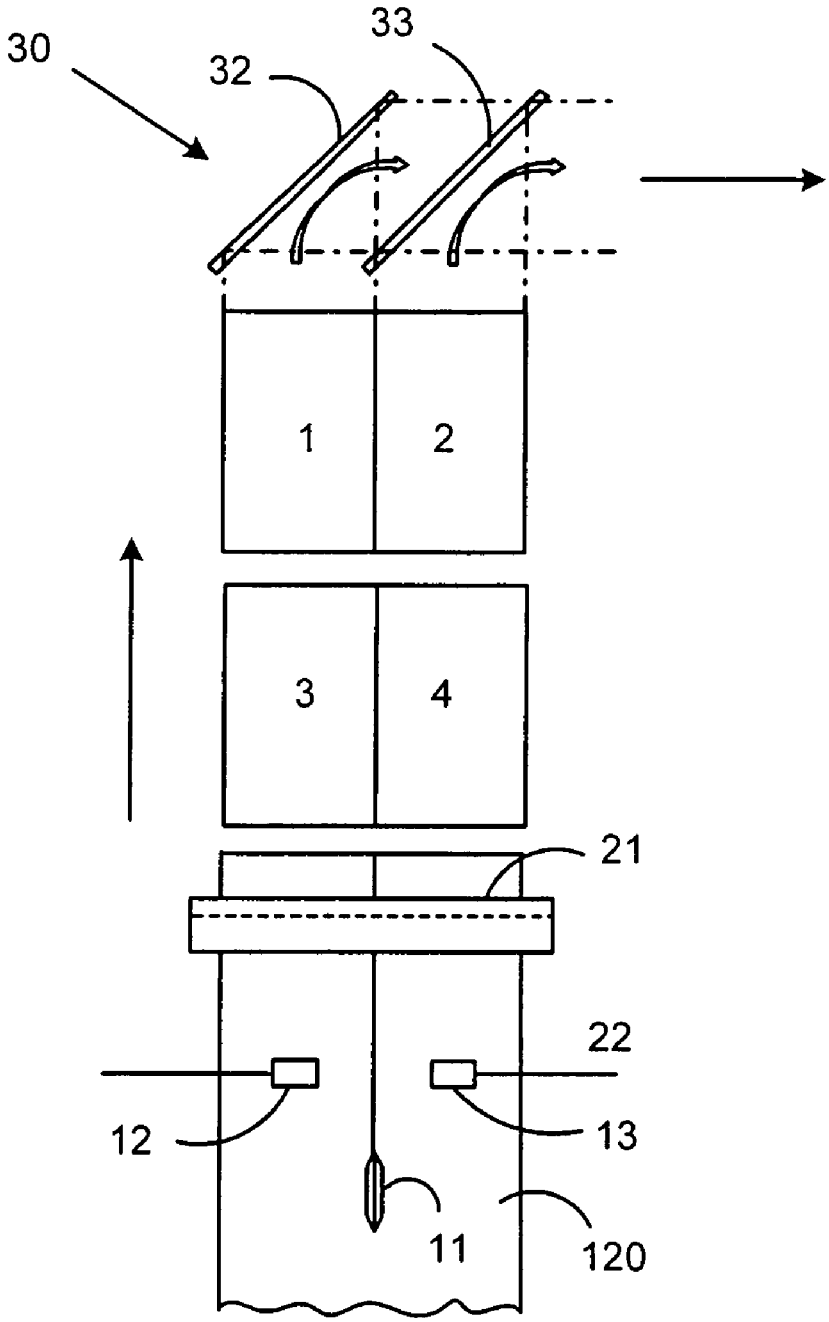
FIG. 3 depicts a problematic arrangement of sheets in a conventional system.

As seen in FIGS. 2 and 3, a conventional inserter input arrangement lacks flexibility when confronted with different configurations of 2-up webs as an input paper source. For right to left web configurations, as seen in FIG. 2, a right hand turn module 30 would be used. For left to right web configurations, as seen in FIG. 3, a left hand turn module 30 would have to be provided, thus requiring different equipment for different configurations of the printed web. Conventional hardware is limited to process one type of print stream.

Conventionally, the left to right web 120 in FIG. 3 cannot normally be processed on a right hand right angle turn module 30 because sheets would be presented to a downstream accumulator in an incorrect order. By changing the guillotine cutter to a left to right style, sheets could be presented in the correct order, but would be accomplished at a significantly reduced throughput because cut times would need to be spaced apart to ensure no overlapping sheets in the right angle turn module 30.

Figure 4:
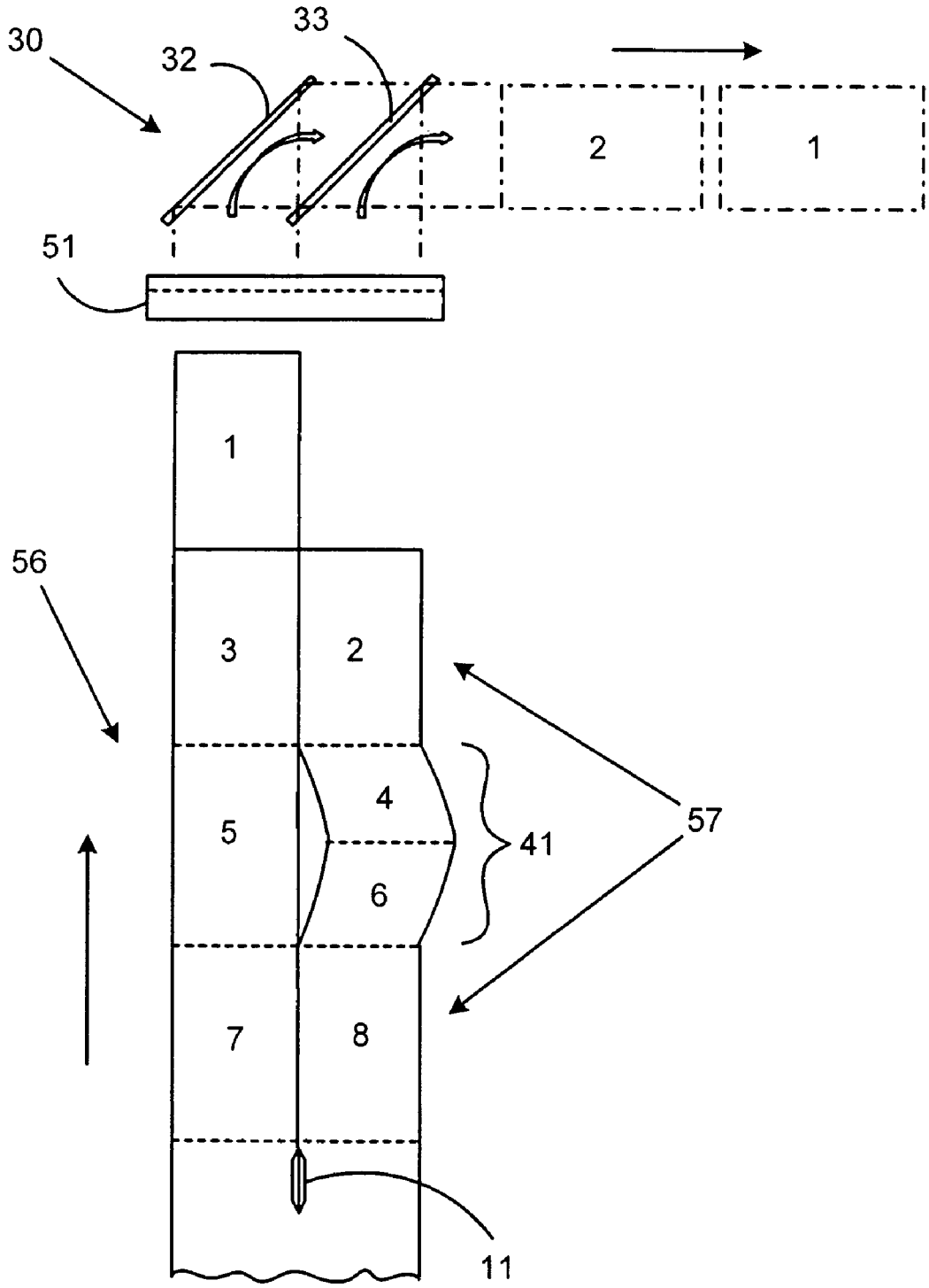
FIG. 4 is a top view of a re-sequencing arrangement.

The improved system described herein provides a method and apparatus to accept any 2-up printed web on the same input hardware without reducing throughput performance. FIG. 4 shows a solution to this problem by center slitting a 2-up web with cutter 11, and then advancing or retarding one side of the web by one sheet length, through a sequencing region 41, before reaching the cutter blade 51. The retarded web portion 57 is depicted on the right, while the advanced web portion 56 is on the left. This web manipulation changes the sequencing order of the cut sheets to be correct before entering the downstream module.

Figure 5:
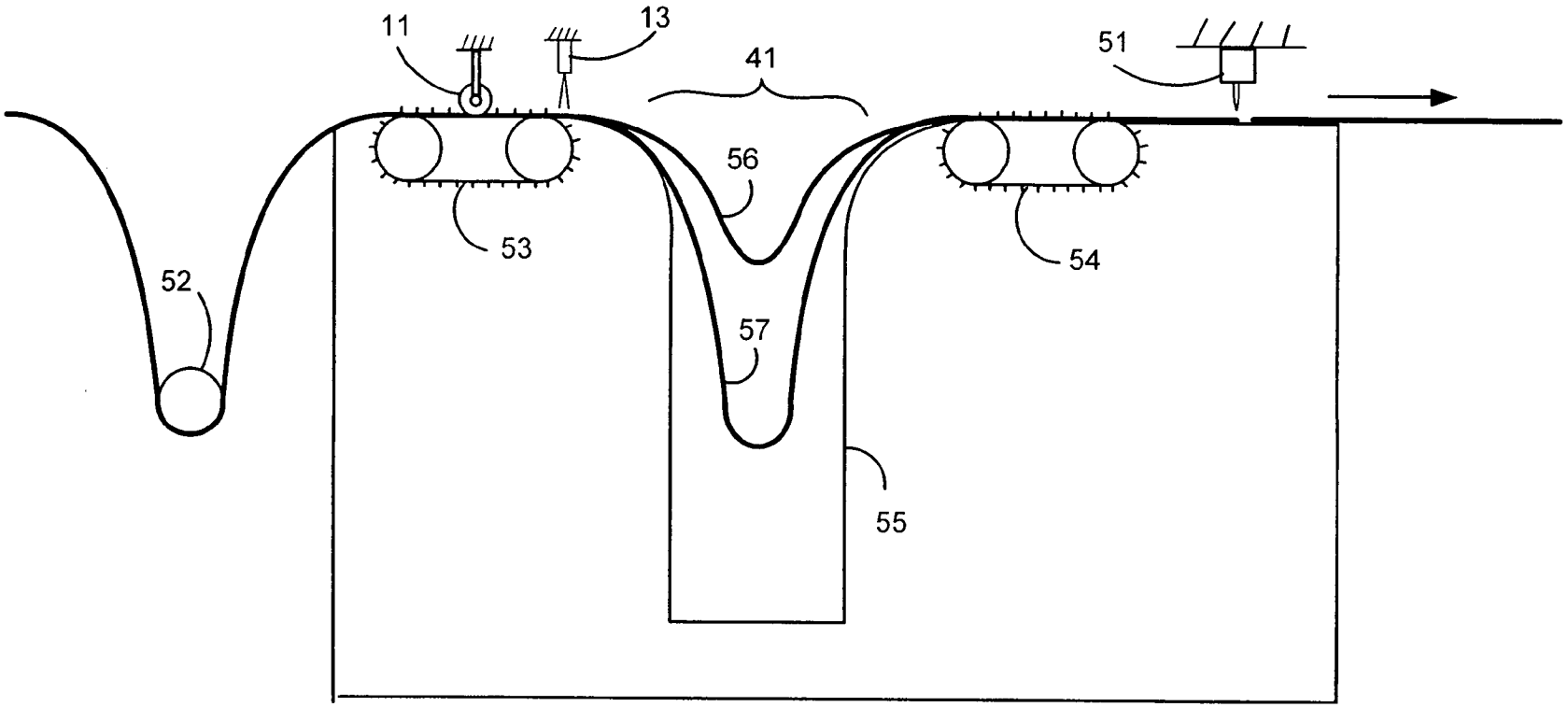
FIG. 5 is a side view of the re-sequencing arrangement of FIG. 4.

FIG. 5 shows a side view of a tractor (pin-holed paper) system with tractors 53 and 54 driving the web portions 56 and 57. Two loops of the web portions 56 and 57, outer and inner, are shown where the longer loop of portion 57 is longer by one cut sheet length over the shorter loop of portion 56. Web portion 57 is destined for the inner path of right angle turn module 30, around turn bar 33. Loops are preferably constrained by a vacuum chamber 55. The shorter loop of web portion 56 may not be a loop at all and could travel from upstream tractor 53 to downstream tractor 54 in a linear fashion through sequencing module 41.

Alternatively, to achieve high cut rates, servo controlled rollers can be substituted for tractors to reduce web forces an eliminate web breakage. Methods for controlling the feeding of a web are known in the art, and do not constitute part of the present invention.

The vacuum chamber 55 may be a dual chamber design, with a thin wall separating the chamber into two for each respective loop. This wall not only prohibits the loops from interfering or colliding with one another during operation but also eliminates vacuum cross flow between the loops. This can maintain loop stability when left and right loop sizes are different by one sheet length.

Referring to FIGS. 4 and 5, to load the web, the operator must thread the web around a dancer roller 52 (if required) and load the web into the upstream tractor assembly 53, upstream of the web center slitter 11, and scanner 13. The operator must then instruct the machine to "Load" and the web is machine advanced through the center slitter 11. The machine displaces the split web just far enough to get past the downstream split tractors 54 if the web was pulled taught. The downstream split tractors 54 consist of individually controlled right and left tractor assemblies. The operator must then load the slit web into both left and right downstream tractors 54 with any resulting loop size. The operator then instructs the machine to be "Ready" and the left and right tractors 54 advance in conjunction with the upstream tractors 53 to generate the two different sized loops.

For applications that do not require corrective sequencing, the loops are the same size. Presence and knowledge of web lead edge positions during loading for machine control is preferably tracked by photocells. In the preferred method, the first sheet or set of sheets are positioned to come to rest one sheet length past the guillotine blade 51 in preparation for an impending cut command.

For high speed operation the transport of the web by the tractors 54 can be supplemented by an additional control nip to provide conveying means near the non-tractor side of the sheet. In such a method, the tractor 54 and roller are used together to control the web. For pinless applications, controlled nips may be required pre and post loop without use of tractor assemblies. Pinless applications also require use of control marks on the web and scanners to detect them to provide feedback to the control system to ensure consistent cut length and location.

Figure 6:
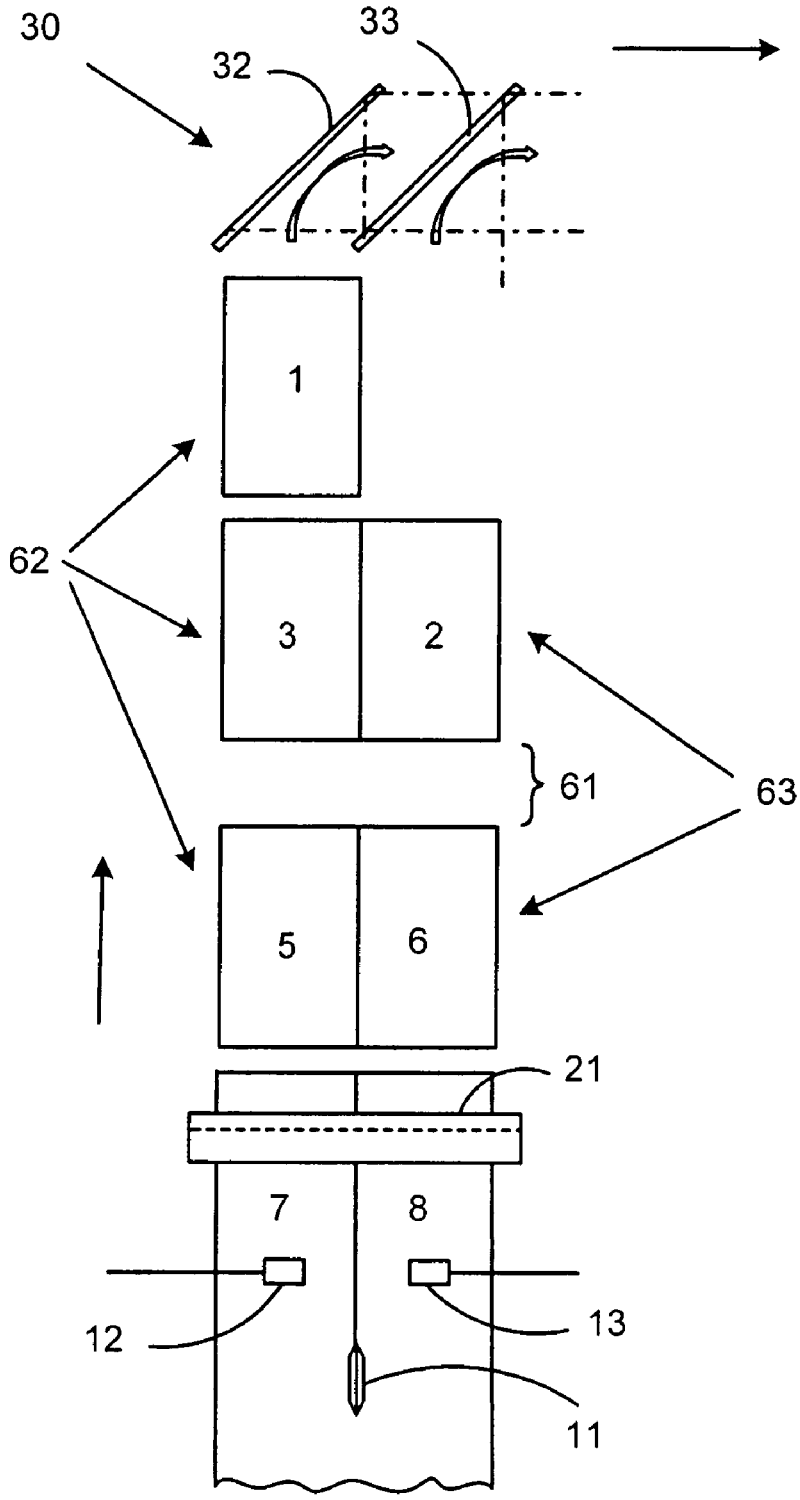
FIG. 6 is a top view of an alternate re-sequencing arrangement.
Figure 7:
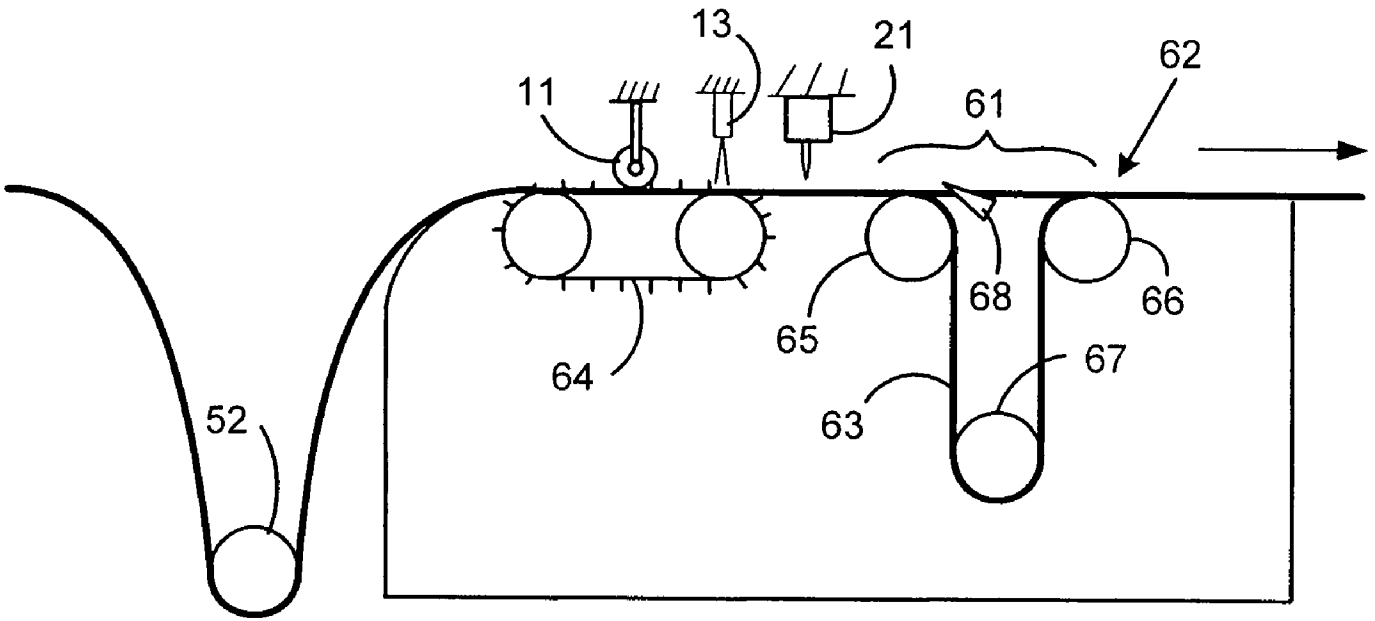
FIG. 7 is a side view of the re-sequencing arrangement of FIG. 6.

FIGS. 6 and 7 illustrate an alternative solution to the problem by introducing a different kind of sequencing or path altering module 61, located downstream of a cutter 21. Sequencing module 61 creates different path lengths for left and right sheets 62 and 63 after they have been cut. Exemplary rollers 65, 66, and 67 maintain positive control for transporting sheets through the sequencing module 61. This web manipulation changes the sequencing order of the cut sheets to be correct before entering the next downstream module.

Tractor 64 (for pin-holed paper) transports the web as it is cut by center slitter 11. The web is then cut transversely into separate sheet by cutter 21. Downstream of cutter 21, sheets 62 destined for the outer right angle turn 30 path (around turn bar 32) travel a shorter path. The shorter path can be substantially a straight line, but may also be a loop. Sheets 63 destined for the inner path (around turn bar 33) travels a longer path through sequencing module 61, that is preferably adjustable, to provide one cut sheet length of additional travel more than the outer path before reaching the right angle turn module 30. The longer path introduces a time delay for the inner path that results in correctly sequencing the sheets before entering the right angle turn module 30 to yield proper downstream accumulation. For webs that do not require corrective sequencing, a flipper gate 68, located at the entrance of the sequencing module 61, can be actuated to allow inner path sheets to bypass the additional travel loop.

For pinless applications, control nips would replace the tractor assembly 64. Pinless applications also require use of control marks on the web and scanners to detect them to provide feedback to the control system to ensure consistent cut length and location.

The configuration depicted in FIGS. 6 and 7 have several advantages over the configuration shown in FIGS. 4 and 5. First, sequencing downstream of the blade will eliminate the introduction of a large upstream control loop module 41 that may be difficult to manage at higher speeds. The downstream sequencing solution introduces the additional path length in a transport that maintains absolute positive control over the paper.

Another advantage is that sequencing downstream of the blade 21 will allow the web to be controlled jointly by both left and right tractor assemblies prior to center slitting during aggressive accelerations as opposed to a pre-blade sequencing solution where each center slit web is being controlled by only one tractor 54.

Finally, because center slitting is accomplished just prior to the blade, the load sequence is simplified over a pre-blade sequencing solution. In its simplest mechanical implementation, a pre-blade solution will require two separate steps for the operator to load the paper.

Although the invention has been described with respect to preferred embodiments thereof, it will be understood by those skilled in the art that the foregoing and various other changes, omissions and deviations in the form and detail thereof may be made without departing from the spirit and scope of this invention.

What is claimed is:

1. A method for cutting and processing sheets from a web of printed material, the web comprised of first and second side-by-side portions of sheets along a length of the web, the first and second portions each having a series of aligning printed sheets, the method comprising:

transporting the web in a first horizontal direction along the length of the web;

splitting the first and second portions of the web as they are transported in the first direction;

cutting the first and second portions transversely to separate them into separate side-by-side sheets;

transporting the first portion of the web on a first path having a first length;

transporting the second portion of the web on a second path having a second length, wherein the first length and the second length are selectively varied to control a downstream sequence order of the sheets; and right angle turning pairs of cut side-by-side sheets traveling in the first direction so that they are reoriented to be traveling serially in a second direction orthogonal to the first direction, whereby after right angle turning, within a pair of turned sheets, a sheet from the second web portion is traveling downstream of a sheet from the first web portion.

2. The method of claim 1 wherein cutting is carried out after transporting the first portion of the web on the first path and transporting the second portion of the web on the second path, and wherein the web is still connected during transport on the first and second paths.

3. The method of claim 2 wherein transporting the second portion of the web on the second path includes transporting a loop of the second web portion through a loop box.

4. The method of claim 3 wherein transporting the first portion of the web on the first path includes causing the first web portion to substantially bypass the loop box.

5. The method of claim 3 wherein transporting the first portion of the web on the first path includes causing the first web portion to be transported in a second loop smaller than the loop of the second web portion.

6. The method of claim 3 further comprising pulling downward on the loop of the second web portion using vacuum in the loop box.

7. The method of claim 1 wherein cutting is carried out before transporting the first portion of the web on the first path and transporting the second portion of the web on the second path, and wherein the web portions are separated into sheets during transport on the first and second paths.

8. The method of claim 7 wherein transporting the second portion of the web on the second path includes diverting sheets from the second web portion through a driven path that dips below a horizontal plane of the first direction.

9. The method of claim 8 wherein transporting the first portion of the web on the first path includes causing the first web to continue to travel horizontally in the first direction while the second portion has been diverted.

10. The method of claim 1 wherein a first sheet from the second web portion undergoes right angle turning by itself, rather than as part of a pair.

* * * * *